US007465177B2

(12) United States Patent
Wood

(10) Patent No.: US 7,465,177 B2
(45) Date of Patent: Dec. 16, 2008

(54) ELECTRICAL CONNECTOR HAVING A FLUID COUPLING

(75) Inventor: Donald Everett Wood, Hummelstown, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/545,968

(22) Filed: Oct. 10, 2006

(65) Prior Publication Data

US 2008/0085620 A1 Apr. 10, 2008

(51) Int. Cl.
*H01R 4/60* (2006.01)

(52) U.S. Cl. ..... 439/191; 439/247

(58) Field of Classification Search ..... 439/178, 439/191

See application file for complete search history.

(56) References Cited

U.S. PATENT DOCUMENTS

| | | | | | |
|---|---|---|---|---|---|
| 2,510,125 | A * | 6/1950 | Meakin | 174/47 |
| 3,673,541 | A * | 6/1972 | Volinskie | 439/195 |
| 4,073,563 | A * | 2/1978 | Bailey et al. | 439/532 |
| 4,507,707 | A * | 3/1985 | Willis | 361/679 |
| 4,538,463 | A * | 9/1985 | Pease | 73/587 |
| 5,637,006 | A * | 6/1997 | Almeras | 439/191 |
| 5,855,493 | A * | 1/1999 | Shelly | 439/465 |
| 5,997,349 | A * | 12/1999 | Yoshioka | 439/579 |
| 6,210,219 | B1 * | 4/2001 | Zhu et al. | 439/567 |
| D458,985 | S * | 6/2002 | Kleffmann | D23/233 |
| 6,427,723 | B2 * | 8/2002 | Bogdanowicz et al. | 137/884 |
| 6,450,202 | B2 * | 9/2002 | Bogdanowicz | 137/625.66 |
| 6,508,653 | B2 * | 1/2003 | Malone et al. | 439/92 |
| D474,449 | S * | 5/2003 | Rosander | D13/147 |
| 6,776,192 | B2 * | 8/2004 | Wigmore | 137/884 |
| 6,814,625 | B2 * | 11/2004 | Richmond et al. | 439/681 |
| 6,843,664 | B2 * | 1/2005 | Belson et al. | 439/105 |
| 7,121,884 | B2 * | 10/2006 | Osada | 439/582 |
| 2002/0070702 | A1 * | 6/2002 | Ragnarsson | 320/101 |

* cited by examiner

*Primary Examiner*—T C Patel
*Assistant Examiner*—Harshad C Patel

(57) ABSTRACT

An electrical connector includes a housing having a mating end, a rear end opposite the mating end, and first and second openings each extending from the mating end to the rear end. An electrical contact is held at least partially within the first opening. A fluid coupling is held at least partially within the second opening. The fluid coupling includes a body having a fluid passageway extending therethrough. The fluid passageway is configured to carry flow of a fluid between the mating and rear ends of the housing.

20 Claims, 5 Drawing Sheets

ELECTRICAL CONNECTOR HAVING A FLUID COUPLING

BACKGROUND OF THE INVENTION

The invention relates generally to electrical connectors and, more particularly, to an electrical connector having a fluid coupling.

Many electronic devices are cooled to remove heat generated during their operation. Cooling of electronic devices may sometimes be accomplished by circulating a flow of a fluid, such as water, through, around, and/or adjacent to the electronic device(s). To deliver the fluid into, around, and/or adjacent to the electronic device(s), the fluid is often circulated through an internal system of tubing that extends within one or more support structures, such as a chassis, which support the electronic device(s). The fluid is supplied from a source connected to the system of tubing, which is often located external to the support structure(s).

However, connecting the internal tubing system to the external source of fluid may be overly complex and/or difficult for some support structures and/or electronic devices. For example, at least some known fluid couplings that interconnect fluid sources with internal tubing systems may be bulkier than desired and/or possible for use with some support structures and/or electronic devices. Support structures that include connectors for high current power supply are one example of structures that may have a limited amount of space for inlet and outlet fluid couplings. Such support structures may therefore be restricted to using fluid couplings below a predetermined size, which may not carry a desired flow rate. It may also be more difficult to assemble and/or repair the fluid couplings of such structures because of the limited space.

A need remains for a less bulky fluid coupling assembly that can be used to connect a fluid source to an internal tubing system that circulates cooling fluid through, around, and/or adjacent an electronic device.

BRIEF DESCRIPTION OF THE INVENTION

In one aspect, an electrical connector is provided that includes a housing having a mating end, a rear end opposite the mating end, and first and second openings each extending from the mating end to the rear end. An electrical contact is held at least partially within the first opening. A fluid coupling is held at least partially within the second opening. The fluid coupling includes a body having a fluid passageway extending therethrough. The fluid passageway is configured to carry flow of a fluid between the mating and rear ends of the housing.

In another aspect, an electrical connector assembly including a pair of connectors configured to be electrically connected to one another is provided. The electrical connector assembly includes first and second connector housings each having a mating end and a rear end opposite the mating end. The first and second connectors are configured to be connected to one another adjacent the respective first and second connector housing mating ends. First and second plugs extend from the first connector housing at the mating end thereof. A first electrical contact is held at least partially within the first plug of the first connector housing. A first fluid coupling is held at least partially within the second plug. The first fluid coupling includes a body having a first fluid passageway configured to carry flow of a fluid between the mating and rear ends of the first connector housing. First and second sockets are provided at the mating end of the second connector housing. A second electrical contact is held at least partially within the first socket of the second connector housing. The first and second electrical contacts are configured to engage one another other when the first and second connector housing are connected to one another. A second fluid coupling is held at least partially within the second socket of the second connector housing. The second fluid coupling includes a second fluid passageway configured to carry flow of a fluid between the mating and rear ends of the second connector housing. The first and second fluid couplings are configured to engage one another such that the first and second passageways are in fluid communication when the first and second connector housings are connected to one another.

DETAILED DESCRIPTION OF THE INVENTION

Figure 1:
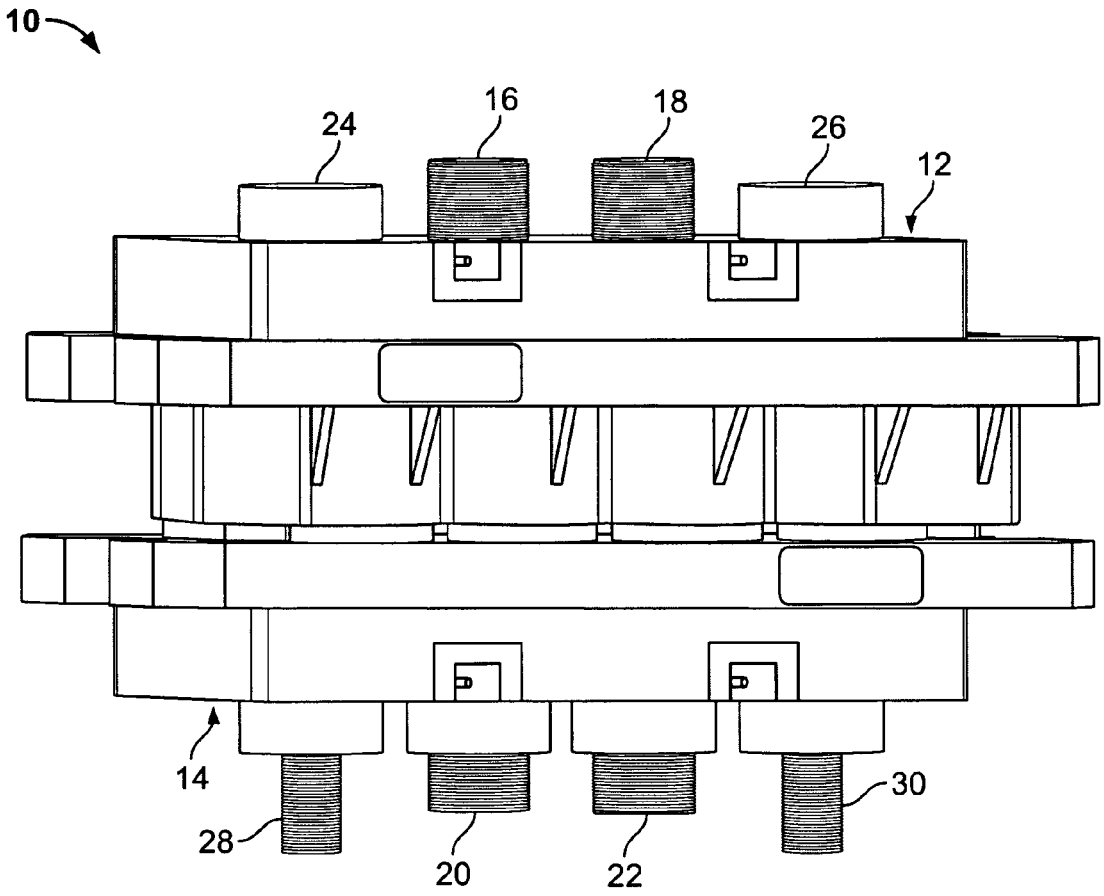
FIG. 1 is a perspective view of an electrical connector assembly formed in accordance with an embodiment of the present invention.

FIG. 1 is a perspective view of an electrical connector assembly 10 formed in accordance with an embodiment of the present invention. The connector assembly 10 includes a pair of electrical connectors 12 and 14 that are configured to be connected to one another, as shown in FIG. 1. The connectors 12 and 14 may each be referred to herein as a first and/or a second connector. As will be described in more detail below, the connector 12 includes a pair of fluid couplings 16 and 18 that each engage a respective fluid coupling 20 and 22 of the connector 14 for carrying flow of a fluid through the connector assembly 10. The fluid couplings 16, 18, 20, and 22 may each be referred to herein as a first and/or a second fluid coupling. The fluid may be used to cool electrical and/or other components (not shown) that are connected, whether electrically or mechanically, to the connector assembly 10, electrical and/or other components that are adjacent the connector assembly 10, and/or electrical and/or other components that are part of a system (not shown) that includes and/or is adjacent to the connector assembly 10. The fluid may be any fluid suitable for cooling electrical and/or other components, such as, but not limited to, water. As described in more detail below, the connector 12 also includes a pair of electrical contacts 24 and 26 that each engages a respective electrical contact 28 and 30 of the connector 14. The electrical contacts 24, 26, 28, and 30 may each be referred to herein as a first and/or a second electrical contact.

Figure 2:
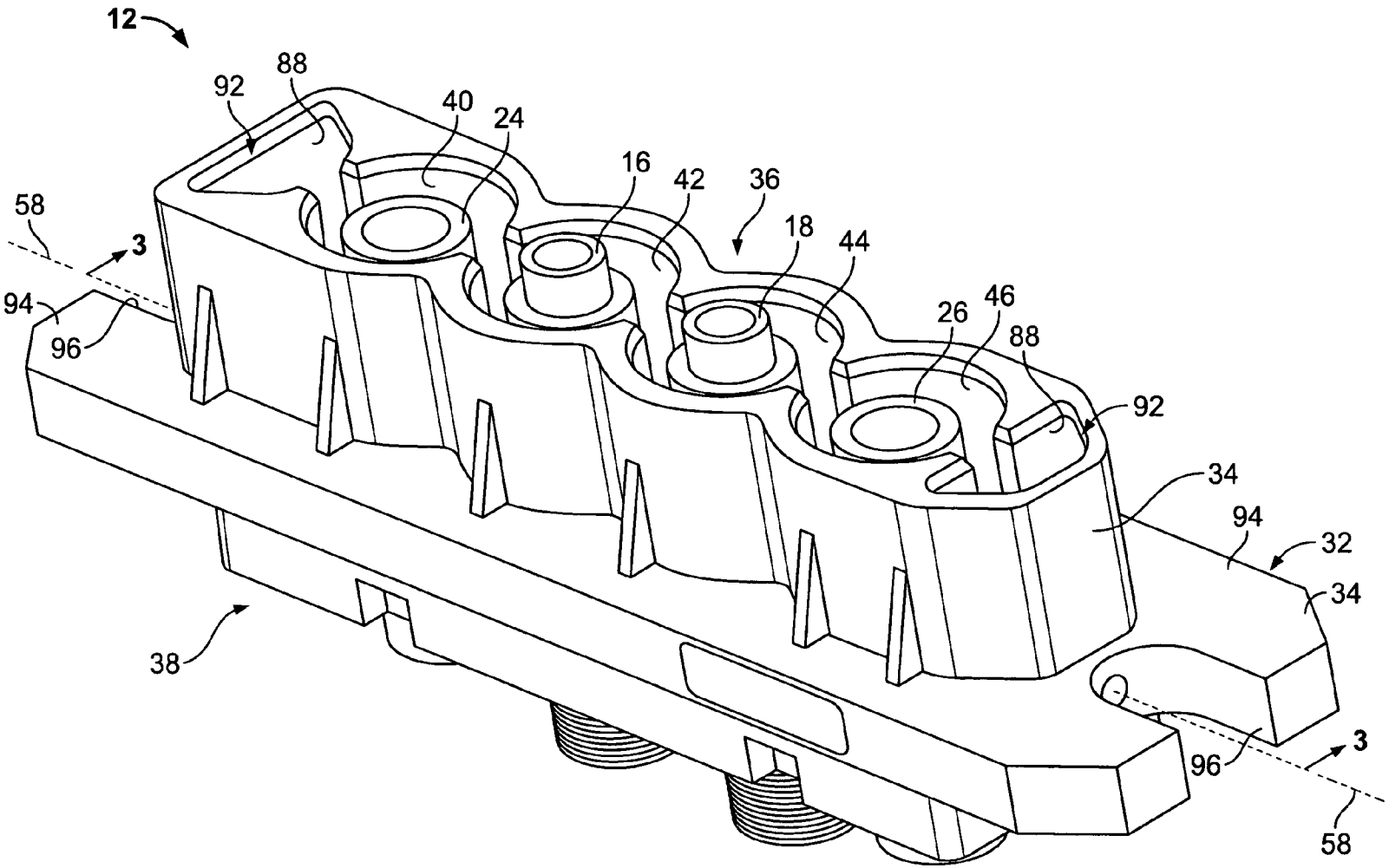
FIG. 2 is a perspective view of one of the electrical connectors shown in FIG. 1 formed in accordance with an embodiment of the present invention.

FIG. 2 is a perspective view of the connector 12 formed in accordance with an embodiment of the present invention. Connector 12 includes a housing 32 having a body 34 extending between a mating end 36 and a rear end 38 opposite the mating end 36. The housing 32 may be referred to herein as a first and/or a second housing. The housing body 34 includes a plurality of sockets 40, 42, 44, and 46 at the mating end 36. The sockets 40, 42, 44, and 46 may each be referred to herein as a first and/or a second socket. The sockets 40, 42, 44, and 46 are each configured, for example sized and shaped, to receive a respective plug 140, 142, 144, and 146 (FIGS. 4 and 5) of the connector 14 therein when the connectors 12 and 14 are connected, as shown in FIG. 1. In the exemplary embodiment, each of the sockets 40, 42, 44, and 46 receives only a portion of the respective plug 140, 142, 144, and 146 therein. However, the sockets 40, 42, 44, and/or 46 may alternatively receive an entirety of the respective plug 140, 142, 144, and 146 therein.

The sockets 40, 42, 44, and 46 may be arranged in any suitable arrangement pattern that enables the sockets 40, 42, 44, and 46 to function as described herein. For example, in the exemplary embodiment, the sockets 40, 42, 44, and 46 are arranged serially in a single row that extends along a longitudinal axis 58 of the housing body 34. In the exemplary embodiment, the row of sockets 40, 42, 44, and 46 is generally straight, although the row may not be straight in some other embodiments. Examples of other suitable patterns include arranging the sockets 40, 42, 44, and 46 in a plurality of rows, and/or staggering adjacent sockets 40, 42, 44, and/or 46 on opposite sides of the longitudinal axis 58 of the housing body 34.

Figure 3:
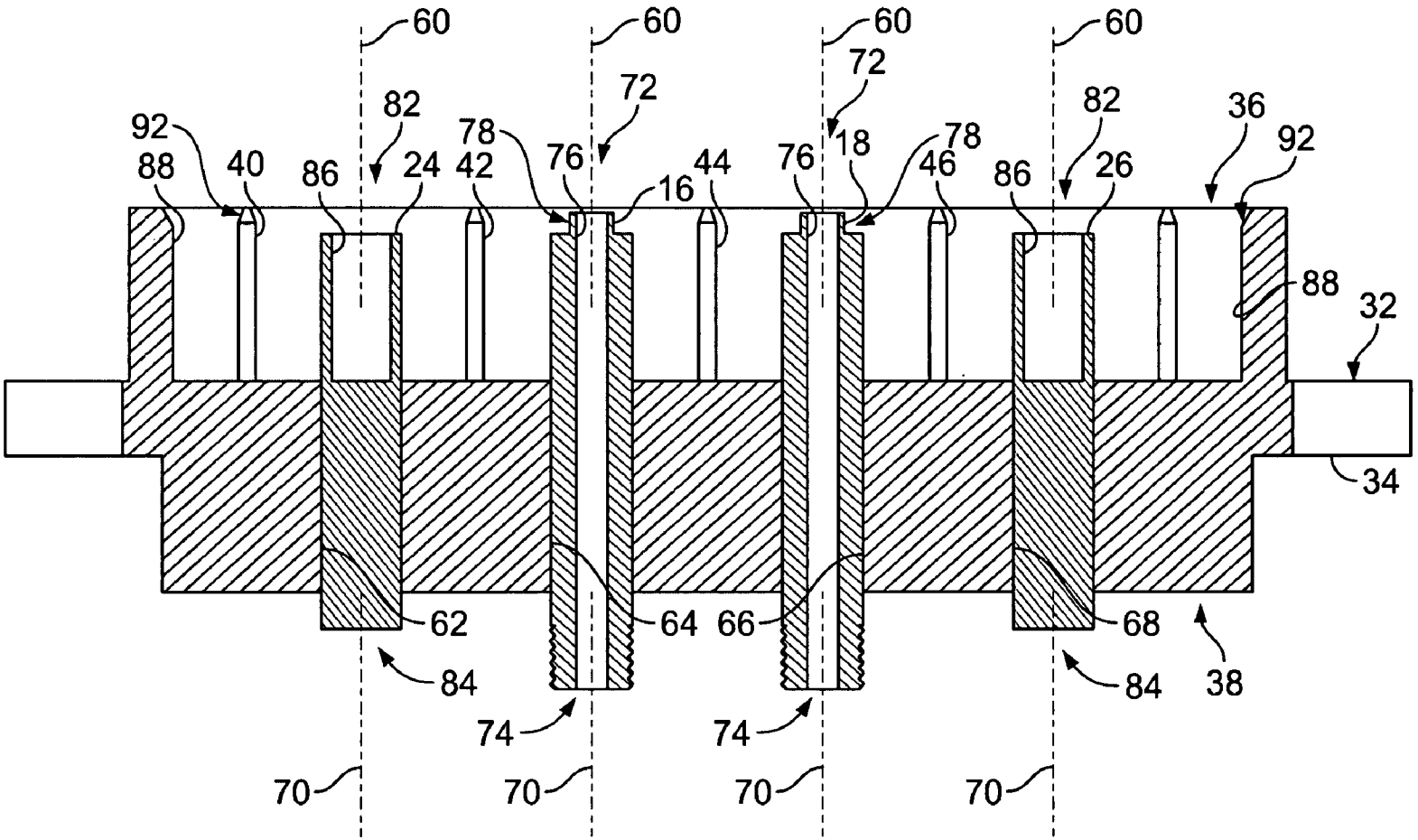
FIG. 3 is a cross-sectional view of the electrical connector shown in FIG. 2 take along line 3-3 of FIG. 2.

FIG. 3 is a cross-sectional view of the connector 12 taken along line 3-3 of FIG. 2. The housing body 34 includes a plurality of openings 62, 64, 66, and 68 that each extend from the mating end 36 to the rear end 38 of the housing body 34. The openings 62, 64, 66, and 68 may each be referred to herein as a first and/or a second opening. The electrical contacts 24 and 26 are held within the openings 62 and 68, respectively, while the fluid couplings 16 and 18 are held within the openings 64 and 66, respectively. (See also FIG. 2). The contacts 24 and 26 are not limited to being positioned within the openings 62 and 68, respectively, and likewise the couplings 16 and 18 are not limited to being positioned within the openings 64 and 66, respectively. Rather, the contacts 24 and 26 and the couplings 16 and 18 may each be held in any of the openings 62, 64, 66, and 68. The electrical contacts 24 and 26 may be held in the openings 62 and 68, respectively, using any suitable structure and/or means, such as, but not limited to, retention clips or fingers (not shown) of the housing body 34 that extend within the openings 62 and 68 and are biased to engage the corresponding electrical contact 24 and 26. Similarly, the fluid couplings 16 and 18 may be held in the openings 64 and 66, respectively, using any suitable structure and/or means, such as, but not limited to, retention clips or fingers (not shown) of the housing body 334 that extend within the openings 64 and 66 and are biased to engage the corresponding fluid coupling 16 and 18.

Each of the openings 62, 64, 66, and 68 extends through a respective socket 40, 42, 44, and 46. A portion of each of the electrical contacts 24 and 26 is held within a respective socket 40 and 46, while a portion of each of the fluid couplings 16 and 18 is held within a respective socket 42 and 44. In the exemplary embodiment, a central longitudinal axis 70 of each of the openings 62, 64, 66, and 68 is aligned with a central longitudinal axis 60 of the respective socket 40, 42, 44, and 46. However, the axis 70 of the openings 62, 64, 66, and/or 68 may alternatively not be aligned with the axis 60 of the respective socket 40, 42, 44, and/or 46. Moreover, each socket 40, 42, 44, and 46 may alternatively have more than one opening extending therethrough, such that more than one electrical contact and/or fluid coupling may be held within one or more of the sockets 40, 42, 44, and 46.

The fluid couplings 16 and 18 each extend between a mating end 72 and a rear end 74 that is opposite the mating end 72. The fluid couplings 16 and 18 each include a fluid passageway 76 extending therethrough. The fluid passageways 76 may each be referred to herein as a first and/or a second fluid passageway. The fluid passageways 76 each carry flow of the fluid between the mating end 36 and the rear end 38 of the housing body 34. The fluid couplings 16 and 18, including the passageways 76, may each include any suitable shape(s) and may be formed from any suitable material(s) that enable the couplings 16 and 18 to function as described herein. For example, in the illustrated embodiment, the fluid couplings 16 and 18 each include a plug 78 at the mating end 72 thereof. The plugs 78 may each be referred to herein as a third plug herein. The plugs 78 are each configured, for example sized and shaped, to be received within a socket 178 (FIG. 5) of the respective fluid coupling 20 and 22 held within the connector 14. The fluid couplings 16 and/or 18 may include a check valve (not shown) or other suitable structure and/or means for blocking fluid flow through the corresponding passageway 76 when the connectors 12 and 14 are not interconnected.

In the exemplary embodiment, the rear end 74 of each of the fluid couplings 16 and 18 is configured to be connected to one or more conduits (not shown) that supply the fluid to and/or adjacent electrical and/or other components (not shown) that are connected, whether electrically or mechanically, to the connector assembly 10, electrical and/or other components that are adjacent the connector assembly 10, and/or electrical and/or other components that are part of a system (not shown) that includes and/or is adjacent to the connector assembly 10 for cooling thereof. Alternatively, the rear end 74 of the fluid couplings 16 and/or 18 is configured to be connected to a source of the fluid.

The electrical contacts 24 and 26 each extend between a mating end 82 and a rear end 84 that is opposite the mating end 82. The electrical contacts 24 and 26 may each include any suitable shape(s) and may be formed from any suitable material(s) that enable the contacts 24 and 26 to function as described herein. For example, in the exemplary embodiment, the electrical contacts 24 and 26 each include a socket 86 at the mating end 82 thereof that is configured, for example sized and shaped, to receive a pin 186 (FIG. 5) of the respective electrical contact 28 and 30 held within the connector 14. The sockets 86 may each be referred to herein as a third socket.

In the exemplary embodiment, the rear end 84 of each of the electrical contacts 24 and 26 is electrically connected to one or more electrical components (not shown) for supplying the electrical component(s) with electrical power from a power source (not shown) that is electrically connected to the electrical contacts 28 and/or 30 of the connector 14. Alternatively, the rear end 84 of the electrical contacts 24 and/or 26 is electrically connected to the power source and the one or more electrical components are electrically connected to the electrical contacts 28 and/or 30.

To facilitate alignment of the connectors 12 and 14 during interconnection thereof, the connector housing 32 includes a pair of female alignment receptacles 88 (see also FIG. 2) at the mating end 36 thereof that each mate with a corresponding male alignment member 188 (FIGS. 4 and 5) of the connector 14. More specifically, the female alignment receptacles 88 are each configured, for example sized and shaped, to receive the corresponding male alignment member 188 therein as the connectors 12 and 14 are interconnected. The female alignment receptacles 88 may include a beveled or tapered entry 92 to facilitate the reception of the corresponding male alignment member 188 within the receptacle 88.

Referring again to FIG. 2, the connector housing 32 includes a pair of opposite mounting flanges 94 for mounting the connector 12 to a support structure (not shown), such as, but not limited to, a panel or a chassis. The mounting flanges 94 may each include a slot 96 for receiving one or more fasteners (not shown) to mount the connector housing 32 to the support structure. The slot 96 may be configured, for example sized and shaped relative to the structure and/or the fastener(s), to allow the connector housing 32 to move relative to the support structure. Movement of the connector housing 32 may facilitate alignment of the connectors 12 and 14 during connection therebetween. The beveled or tapered entry 92 of the female alignment receptacle 88, when included, may facilitate or cause such movement of the connector housing 32 relative to the support structure.

Figure 4:
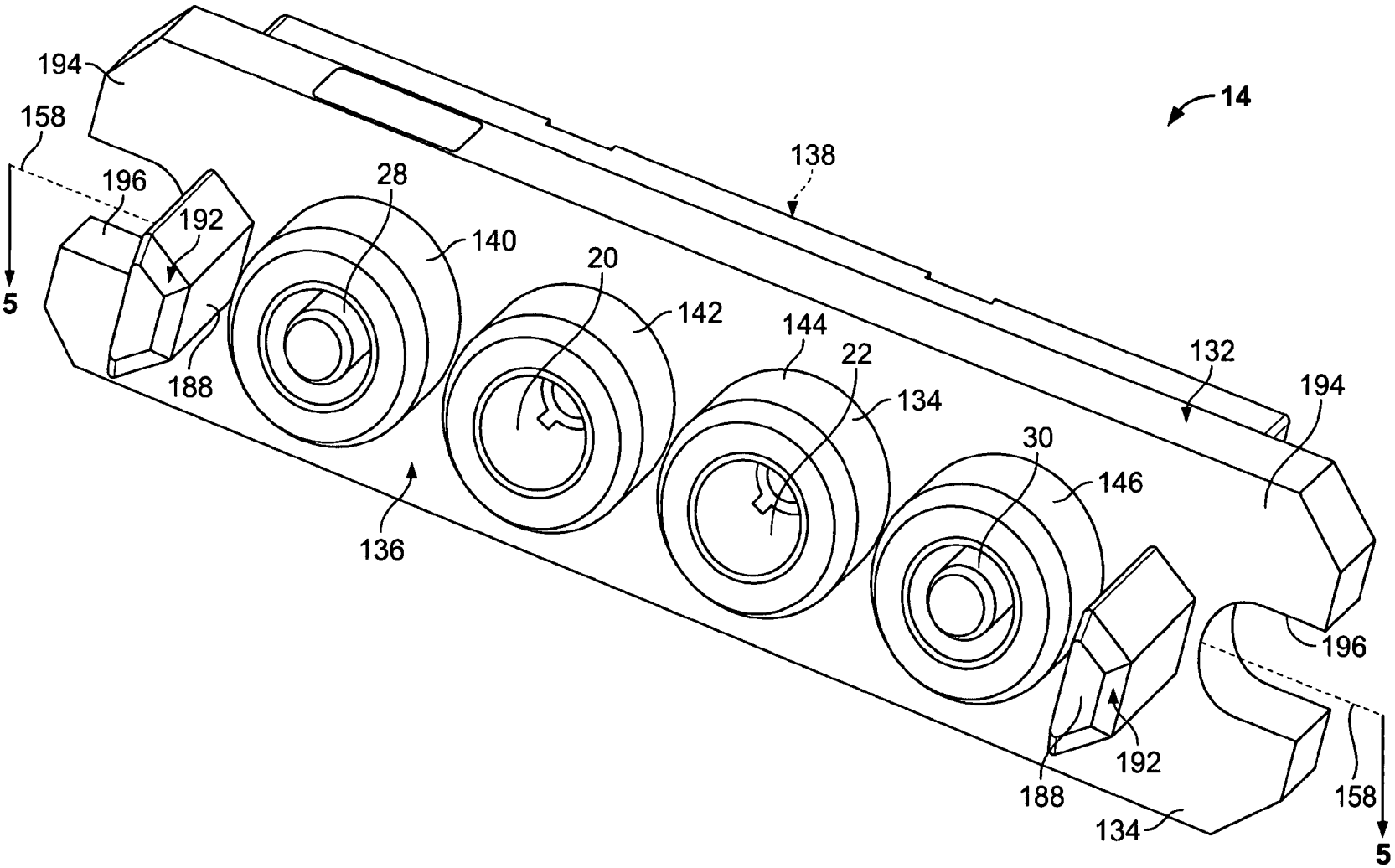
FIG. 4 is a perspective view of another of the electrical connectors shown in FIG. 1 formed in accordance with an embodiment of the present invention.

FIG. 4 is a perspective view of the connector 14 formed in accordance with an embodiment of the present invention. Connector 14 includes a housing 132 having a body 134 extending between a mating end 136 and a rear end 138 opposite the mating end 136. The housing 132 may be referred to herein as a first and/or a second housing. The housing body 134 includes a plurality of plugs 140, 142, 144, and 146 extending therefrom at the mating end 136. The plugs 140, 142, 144, and 146 may each be referred to herein as a first and/or a second plug. The plugs 140, 142, 144, and 146 are each configured, for example sized and shaped, to be at least partially received within the respective socket 40, 42, 44, and 46 (FIGS. 2 and 3) of the connector 12 when the connectors 12 and 14 are connected, as shown in FIG. 1.

The plugs 140, 142, 144, and 146 may be arranged in any suitable arrangement pattern that enables the plugs 140, 142, 144, and 146 to function as described herein. For example, in the exemplary embodiment, the plugs 140, 142, 144, and 146 are arranged serially in a single row that extends along a longitudinal axis 158 of the housing body 134. In the exemplary embodiment, the row of plugs 140, 142, 144, and 146 is generally straight, although the row may not be straight in some other embodiments. Examples of other suitable patterns include arranging the plugs 140, 142, 144, and 146 in a plurality of rows, and/or staggering adjacent plugs 140, 142, 144, and/or 146 on opposite sides of the longitudinal axis 158 of the housing body 134.

Figure 5:
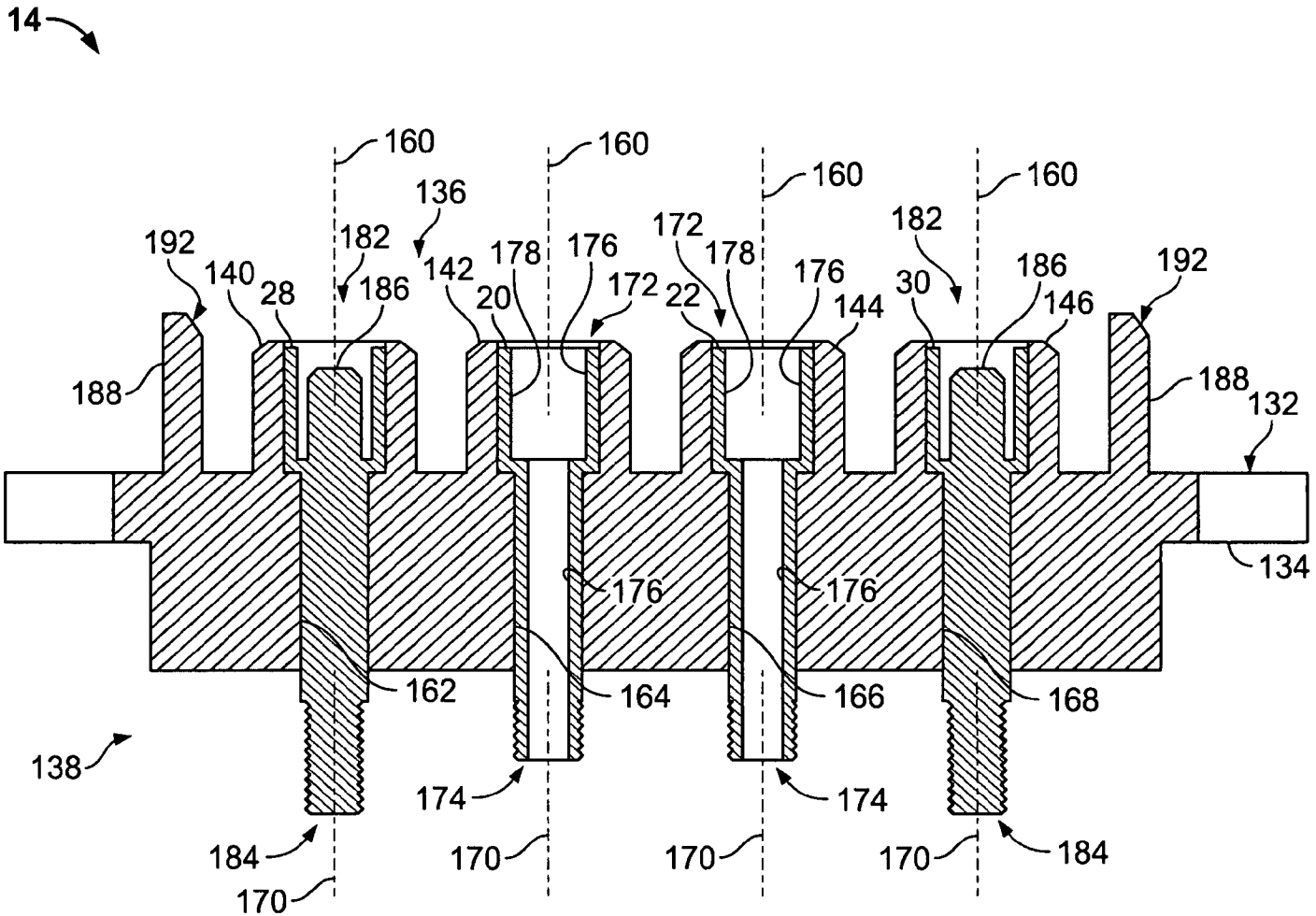
FIG. 5 is a cross-sectional view of the electrical connector shown in FIG. 4 take along line 5-5 of FIG. 4.

FIG. 5 is a cross-sectional view of the connector 14 taken along line 5-5 of FIG. 4. The housing body 134 includes a plurality of openings 162, 164, 166, and 168 that each extend from the mating end 136 to the rear end 138 of the housing body 134. The openings 162, 164, 166, and 168 may each be referred to herein as a first and/or a second opening. The electrical contacts 28 and 30 are held within the openings 162 and 168, respectively, while the fluid couplings 20 and 22 are held within the openings 164 and 166, respectively. (See also FIG. 4). The contacts 28 and 30 are not limited to being positioned within the openings 162 and 168, respectively, and likewise the couplings 20 and 22 are not limited to being positioned within the openings 164 and 166, respectively. Rather, the contacts 28 and 30 and the couplings 20 and 22 may each be held in any of the openings 162, 164, 166, and 168. The electrical contacts 28 and 30 may be held in the openings 162 and 168, respectively, using any suitable structure and/or means, such as, but not limited to, retention clips or fingers (not shown) of the housing body 134 that extend within the openings 162 and 168 and are biased to engage the corresponding electrical contact 28 and 30. Similarly, the fluid couplings 20 and 22 may be held in the openings 164 and 166, respectively, using any suitable structure and/or means, such as, but not limited to, retention clips or fingers (not shown) of the housing body 134 that extend within the openings 164 and 166 and are biased to engage the corresponding fluid coupling 20 and 22.

Each of the openings 162, 164, 166, and 168 extends through a respective plug 140, 142, 144, and 146. A portion of each of the electrical contacts 28 and 30 is held within a respective plug 140 and 146, while a portion of each of the fluid couplings 20 and 22 is held within a respective plug 142 and 144. In the exemplary embodiment, a central longitudinal axis 170 of each of the openings 162, 164, 166, and 168 is aligned with a central longitudinal axis 160 of the respective plug 140, 142, 144, and 146. However, the axis 170 of the openings 162, 164, 166, and/or 168 may alternatively not be aligned with the axis 160 of the respective plug 140, 142, 144, and/or 146. Moreover, each plug 140, 142, 144, and 146 may alternatively have more than one opening extending therethrough, such that more than one electrical contact and/or fluid coupling may be held within one or more of the plugs 140, 142, 144, and 146.

The fluid couplings 20 and 22 each extend between a mating end 172 and a rear end 174 that is opposite the mating end 172. The fluid couplings 20 and 22 each include a fluid passageway 176 extending therethrough. The fluid passageways 176 may each be referred to herein as a first and/or a second fluid passageway. The fluid passageways 176 each carry flow of the fluid between the mating end 136 and the rear end 138 of the housing body 134. The fluid couplings 20 and 22, including the passageways 176, may each include any suitable shape(s) and may be formed from any suitable material(s) that enable the couplings 20 and 22 to function as described herein. For example, in the illustrated embodiment, the fluid couplings 20 and 22 each include a socket 178 at the mating end 172 thereof. The sockets 178 may each be referred to herein as a third socket. The sockets 178 are each configured, for example sized and shaped, to receive the plug 78 (FIG. 3) of the respective fluid coupling 16 and 18 held within the connector 14. When the plugs 78 of each of the fluid couplings 16 and 18 are received within the corresponding socket 178 of the fluid couplings 20 and 22, respectively, the corresponding fluid passageways 76 and 176 are in fluid communication such that can they carry a flow of the fluid through the connector assembly 10. The fluid couplings 20 and/or 22 may include a check valve (not shown) or other suitable structure and/or means for blocking fluid flow through the corresponding passageway 76 when the connectors 12 and 14 are not interconnected.

In the exemplary embodiment, the rear end 174 of each of the fluid couplings 20 and 22 is configured to be connected to a source of the fluid. Alternatively, the rear end 174 of the fluid couplings 20 and/or 22 is configured to be connected to one or more conduits (not shown) that supply the fluid to and/or adjacent electrical and/or other components (not shown) that are connected, whether electrically or mechanically, to the connector assembly 10, electrical and/or other components that are adjacent the connector assembly 10, and/or electrical and/or other components that are part of a system (not shown) that includes and/or is adjacent to the connector assembly 10 for cooling thereof.

The electrical contacts 28 and 30 each extend between a mating end 182 and a rear end 184 that is opposite the mating end 182. The electrical contacts 28 and 30 may each include any suitable shape(s) and may be formed from any suitable material(s) that enable the contacts 28 and 30 to function as described herein. For example, in the exemplary embodiment, the electrical contacts 28 and 30 each include a pin 186 at the mating end 182 thereof that is configured, for example sized and shaped, to be received within the socket 86 (FIG. 3) of the respective electrical contact 24 and 26 held within the connector 12.

In the exemplary embodiment, the rear end 184 of each of the electrical contacts 28 and 30 is electrically connected to a power source (not shown) for supplying one or more electrical components (not shown) that are electrically connected to the electrical contacts 24 and/or 26 with electrical power. Alternatively, the rear end 184 of the electrical contacts 28 and/or 30 is electrically connected to the one or more electrical components and the electrical contacts 24 and/or 26 are electrically connected to the power source.

As discussed above, to facilitate alignment of the connectors 12 and 14 during interconnection thereof, the connector housing 132 includes a pair of male alignment members 188 (see also FIG. 4) extending from the housing 132 at the mating end 136 thereof that each mate with the corresponding female alignment receptacle 88 (FIGS. 2 and 3) of the connector 12. More specifically, the male alignment members 188 are each configured, for example sized and shaped, to be received within the corresponding female alignment receptacle 88 as the connectors 12 and 14 are interconnected. The female alignment receptacles 88 and the male alignment members 188 are positioned and oriented on the respective connectors 12 and 14 such that as the receptacles 88 and the members 188 are mated together, the fluid couplings 16 and 18 of the connector 12 are aligned with the fluid couplings 20 and 22, respectively, of the connector 14, and the electrical contacts 24 and 26 of the connector 12 are aligned with the electrical contacts 28 and 30, respectively, of the connector 14. The male alignment members 188 may each include a beveled or tapered tip 192 to facilitate reception within the corresponding female alignment receptacle 88.

Referring again to FIG. 4, the connector housing 132 includes a pair of opposite mounting flanges 194 for mounting the connector 12 to a support structure (not shown), such as, but not limited to, a panel or a chassis. The mounting flanges 194 may each include a slot 196 for receiving one or more fasteners (not shown) to mount the connector housing 132 to the support structure. The slot 196 may be configured, for example sized and shaped relative to the structure and/or the fastener(s), to allow the connector housing 132 to move relative to the support structure. Movement of the connector housing 132 may facilitate alignment of the connectors 12 and 14 during connection therebetween. The beveled or tapered tip 192 of the male alignment member 188, when included, may facilitate or cause such movement of the connector housing 132 relative to the support structure.

In the exemplary embodiment, the electrical contact pairs 24 and 28 and 26 and 30 are power contacts that supply electrical power from a power source (not shown) to power operation of electrical components (not shown) that are electrically connected to one or both of the contact pairs 24 and 28 and 26 and 30. However, the electrical contact pairs 24 and 28 and/or 26 and 30 may alternatively be signal contacts that transmit electrical signals between electrical components (not shown) that are electrically connected to the contact pairs 24 and 28 and/or 26 and 30. Moreover, in the exemplary embodiment, the electrical connector assembly 10 is configured as a panel-mount assembly. However, the electrical connector assembly 10 may be configured to mount on any suitable structure(s), such as, but not limited to, printed circuit boards or a busbars.

As illustrated, the connector assembly 10 is a blind mate connector assembly. However, the engagement between the fluid couplings 16 and 20 and 18 and 22, as well as the engagement between the contacts 24 and 28 and 26 and 30, may alternatively be visible during connection of the connectors 12 and 14. Although the connector 12 is described and illustrated herein as a receptacle connector that receives a portion of the connector 14 therein, the connector 14 may alternatively be a receptacle connector that receives a portion of the connector 12 therein. Moreover, although the connectors 12 and 14 are each described and illustrated herein as including two fluid couplings 16, 18, 20, and 22, respectively, the connector 12 may include any number of fluid couplings that each engage any number of fluid couplings of the connector 14, and vice versa. Furthermore, although the connectors 12 and 14 are each described and illustrated herein as including two electrical contacts 24, 26, 28, and 30, respectively, the connector 12 may include any number of electrical contacts that each engage any number of electrical contacts of the connector 14, and vice versa Although four sockets 40, 42, 44, and 46 and four plugs 140, 142, 144, and 146 are illustrated, the connector 12 may include any number of sockets for receiving any number of plugs of the connector 14 therein. Although each socket 40, 42, 44, and 46 has a generally cylindrical shape in the exemplary embodiment, each socket 40, 42, 44, and 46 may include any suitable shape that enables the socket 40, 42, 44, and 46 to function as described herein. Similarly, although each plug 140, 142, 144, and 146 includes a generally circular cross-sectional shape in the exemplary embodiment, each plug 140, 142, 144, and 146 may include any suitable shape that enables the plugs 140, 142, 144, and 146 to function as described herein.

Although four openings 62, 64, 66, and 68 are illustrated, the housing body 34 may include any number of openings for any number of fluid couplings and electrical contacts. Similarly, although four openings 162, 164, 166, and 168 are illustrated, the housing body 134 may include any number of openings for any number of fluid couplings and electrical contacts.

In an alternative embodiment, the fluid couplings 16 and/or 18 may include a socket (not shown) at the mating end 72 thereof that is configured, for example sized and shaped, to receive a plug (not shown) of the respective fluid coupling 20 and 22 of the connector 14. Moreover, the fluid couplings may alternatively have other shapes than a socket or a plug such that the couplings 16 and 18 engage the respective coupling 20 and 22 of the connector 14 in a different manner than a socket/plug relationship. Although illustrated as including a generally circular cross-sectional shape, the plugs 78 of the fluid couplings 16 and 18 may include any other suitable shape(s) that enables them to function as described herein. Similarly, although illustrated as including a generally circular cross-sectional shape, the plugs 178 of the fluid couplings 20 and 22 may include any other suitable shape(s) that enables them to function as described herein.

Although illustrated as generally cylindrical, the sockets 86 of the electrical contacts 24 and 26 and the pins 186 of the electrical contacts 28 and 30 may include any other suitable shape(s) that enables them to function as described herein. Alternatively, the electrical contacts 24 and/or 26 may include a pin (not shown) at the mating end 82 thereof that is configured, for example sized and shaped, to be received within a socket (not shown) of the respective electrical contact 28 and 30 of the connector 14. Moreover, the electrical contacts may alternatively include other shapes than a socket or a pin such that the contacts 24 and/or 26 engage the respective contact 28 and 30 of the connector 14 in a different manner than a socket/pin relationship.

Although two female alignment receptacles 88 and two male alignment members 188 are illustrated, the connector 12 may include any number of female alignment receptacles 88 for mating with any number of male alignment members 188 of the connector 14. Alternatively, the connector 12 may include one or more male alignment members (not shown) extending from the mating end 36 thereof that mate with one or more corresponding female alignment receptacle (not shown) of the connector 14. The connector assembly 10 may alternatively not include any male alignment members or female alignment receptacles.

The embodiments described herein provide an electrical connector that includes one or more fluid couplings for carrying a flow of fluid through an electrical connector assembly. The fluid coupling(s) may be attached to inlet and/or outlet conduits before being inserted within the electrical connector. Moreover, the fluid coupling(s) may be inserted within, and removed from the electrical connector using conventional power contact assembly and extraction tools. Furthermore, the electrical connectors of the assembly may facilitate reducing side loading stress during interconnection thereof. The use of the same connector may facilitate ease of assembly and/or repair of the electrical connector assembly.

Exemplary embodiments are described and/or illustrated herein in detail. The embodiments are not limited to the specific embodiments described herein, but rather, components and/or steps of each embodiment may be utilized independently and separately from other components and/or steps described herein. Each component, and/or each step, can also be used in combination with other components and/or steps. When introducing elements/components/etc. described and/or illustrated herein, the articles "a", "an", "the", "said", and "at least one" are intended to mean that there are one or more of the element(s)/component(s)/etc. The terms "comprising", "including" and "having" are intended to be inclusive and mean that there may be additional element(s)/component(s)/etc. other than the listed element(s)/component(s)/etc.

While the invention has been described in terms of various specific embodiments, those skilled in the art will recognize that the invention can be practiced with modification within the spirit and scope of the claims.

What is claimed is:

1. An electrical connector comprising:

a housing having a mating end, a rear end opposite the mating end, first and second openings each extending from the mating end to the rear end;

an electrical contact held at least partially within the first opening, the electrical contact comprising a receptacle configured to at least partially receive a pin of another electrical contact of another electrical connector, the electrical contact being surrounded by a portion of the mating end of the housing that is spaced from the electrical contact by a radial gap; and a fluid coupling held at least partially within the second opening, the fluid coupling comprising a body having a fluid passageway extending therethrough, the fluid passageway configured to carry flow of a fluid between the mating and rear ends of the housing.

2. The connector of claim 1, further comprising first and second plugs extending from the housing at the mating end thereof, the first opening extending through the first plug such that a portion of the electrical contact is held within the first plug, the second opening extending through the second plug such that a portion of the fluid coupling is held within the second plug.

3. The connector of claim 1, wherein the housing comprises first and second sockets at the mating end thereof, the first opening extending through the first socket such that a portion of the electrical contact is held within the first socket, the second opening extending through the second socket such that a portion of the fluid coupling is held within the second socket.

4. The connector of claim 1, wherein the fluid coupling body extends between a rear end and an opposite mating end that is adjacent the housing mating end, the fluid coupling mating end comprising a plug configured to be at least partially received within a socket of another fluid coupling of another electrical connector.

5. The connector of claim 1, wherein the fluid coupling body extends between a rear end and an opposite mating end that is adjacent the housing mating end, the fluid coupling mating end comprising a socket configured to at least partially receive a plug of another fluid coupling of another electrical connector.

6. The connector of claim 1, wherein the connector is a blind mate connector.

7. The connector of claim 1, further comprising a male alignment member extending from the housing at the mating end thereof, the male alignment member matable with a female alignment receptacle of another electrical connector.

8. The connector of claim 1, further comprising a female alignment receptacle extending from the housing at the mating end thereof, the female alignment receptacle matable with a male alignment member of another electrical connector.

9. The connector of claim 1, wherein the electrical contact supplies electrical power.

10. The connector of claim 1, wherein the housing comprises a mounting flange for mounting the electrical connector to a support structure, the mounting flange having at least one slot configured such that the housing is capable of moving relative to a structure to which the housing is mounted.

11. The connector of claim 1, wherein the radial gap between the electrical contact and the housing is approximately the same about a perimeter of the electrical contact.

12. The connector of claim 1, wherein the portion of the housing surrounding the electrical contact defines a socket, wherein no other electrical contacts are held within the socket.

13. An electrical connector assembly including a pair of connectors configured to be connected to one another, the electrical connector assembly comprising:

first and second connector housings each having a mating end and a rear end opposite the mating end, the first and second connectors configured to be connected to one another adjacent the respective first and second connector housing mating ends;

first and second plugs extending from the first connector housing at the mating end thereof;

a first electrical contact held at least partially within the first plug of the first connector housing;

a first fluid coupling held at least partially within the second plug of the first connector housing, the first fluid coupling comprising a body having a first fluid passageway configured to carry flow of a fluid between the mating and rear ends of the first connector housing;

first and second sockets at the mating end of the second connector housing;

a second electrical contact held at least partially within the first socket of the second connector housing, the first and second electrical contacts configured to engage one another other when the first and second connector housing are connected to one another, one of the first and second electrical contacts comprising a receptacle configured to at least partially receive a pin of the other of the first and second electrical contacts when the first and second connector housings are connected to one another, the first or second electrical contact comprising the receptacle being at least partially surrounded by a portion of the mating end of the respective first or second connector housing that is spaced from the respective first or second electrical contact by a radial gap; and a second fluid coupling held at least partially within the second socket of the second connector housing, the second fluid coupling comprising a second fluid passageway configured to carry flow of a fluid between the mating and rear ends of the second connector housing, the first and second fluid couplings configured to engage one another such that the first and second passageways are in fluid communication when the first and second connector housings are connected to one another.

14. The assembly of clam 13, wherein the first electrical contact comprises the pin at the mating end of the first connector housing and the second electrical contact comprises the receptacle at the mating end of the second connector housing, the receptacle of the second electrical contact configured to at least partially receive the pin of the first electrical contact.

15. The assembly of claim 13, wherein the first fluid coupling comprising a third plug at the mating end of the first connector housing and the second fluid coupling comprising a third socket at the mating end of the second connector housing, the third socket of the second fluid coupling configured to at least partially receive the third plug of the first fluid coupling.

16. The assembly of claim 13, a male alignment member extending from the first connector housing at the mating end thereof and a female alignment receptacle at the mating end of the second connector housing, the male alignment member and the female alignment receptacle matable such that during mating of the male alignment member and the female alignment receptacle at least one of the first and second connector housings is free to move relative to a structure to which one of the first and second connector housings is mounted.

17. The assembly of claim 13, a male alignment member extending from the second connector housing at the mating end thereof and a female alignment receptacle at the mating end of the first connector housing, the male alignment member and the female alignment receptacle matable such that during mating of the male alignment member and the female alignment receptacle at least one of the first and second connector housings is free to move relative to a structure to which one of the first and second connector housings is mounted.

18. The assembly of claim 13, wherein the connector assembly is a blind mate connector assembly.

19. The assembly of claim 13, wherein the at least one of the first connector housing and the second connector housing comprises a mounting flange for mounting the connector to a support structure, the mounting flange having at least one slot configured such that the housing is capable of floating relative to a structure to which the housing is mounted.

20. The assembly of claim 13, wherein at least one of the first and second electrical contacts supply electrical power.

* * * * *